US010641497B2

(12) United States Patent
Park et al.

(10) Patent No.: US 10,641,497 B2
(45) Date of Patent: May 5, 2020

(54) COOKTOP APPLIANCE

(71) Applicant: Haier US Appliance Solutions, Inc., Wilmington, DE (US)

(72) Inventors: Seung-Yeong Park, Seongnam (KR); Woong Jeon, Hwaseong (KR); Kyungjun Lee, Seoul (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 412 days.

(21) Appl. No.: 15/696,464

(22) Filed: Sep. 6, 2017

(65) Prior Publication Data

US 2019/0072280 A1 Mar. 7, 2019

(51) Int. Cl.

| | |
|---|---|
| ***H05B 1/02*** | (2006.01) |
| ***F24C 7/08*** | (2006.01) |
| ***H05B 6/06*** | (2006.01) |

(52) U.S. Cl.

CPC ..... *F24C 7/083* (2013.01); *F24C 7/087* (2013.01); *H05B 1/0266* (2013.01); *H05B 6/062* (2013.01); *H05B 2213/07* (2013.01)

(58) Field of Classification Search

CPC .. H05B 1/0266; H05B 1/0263; H05B 1/0261; H05B 3/0076; H05B 2213/04; F24C 7/083; F24C 7/043; F24C 7/046; F24C 7/085; F24C 7/088

USPC ..... 219/494, 497, 505, 411–413, 446.1, 219/448.11, 448.14

See application file for complete search history.

(56) References Cited

U.S. PATENT DOCUMENTS

| | | | | |
|---|---|---|---|---|
| 4,913,038 | A * | 4/1990 | Burkett | A47J 37/1266 99/329 R |
| 9,006,622 | B2 | 4/2015 | Beverly et al. | |
| 9,857,082 | B2 * | 1/2018 | McKee | F24C 7/088 |
| 10,260,755 | B2 * | 4/2019 | Bach | F24C 7/087 |
| 10,520,199 | B2 * | 12/2019 | Polster | A21B 1/40 |

FOREIGN PATENT DOCUMENTS

| | | |
|---|---|---|
| WO | WO2016070233 A1 | 5/2016 |

* cited by examiner

*Primary Examiner* — Mark H Paschall

(74) *Attorney, Agent, or Firm* — Dority & Manning, P.A.

(57) ABSTRACT

A cooktop appliance includes an electric heating element positioned on a cooktop surface and a controller operably connected thereto. The controller is configured for monitoring a temperature with a temperature sensor, adjusting a power level of the electric heating element based at least in part on the monitored temperature over a first period of time, and deactivating the electric heating element for a second period of time based at least in part on the monitored temperature. The controller is also configured for storing the first period of time, an average power level over the first period of time, and the second period of time in a memory. When the controller detects a disconnection of the temperature sensor, the controller operates the heating element at the stored average power level for the stored first period of time and deactivates the heating element for the stored second period of time.

20 Claims, 6 Drawing Sheets

COOKTOP APPLIANCE

FIELD

The present subject matter relates generally to cooktop appliances, or more particularly to methods for operating cooktop appliances.

BACKGROUND

Cooktop appliances generally include heating elements for heating cooking utensils, such as pots, pans and griddles. A user can select a desired heating level, and operation of the heating elements is modified to match the desired heating level. For example, certain cooktop appliances include electric heating elements. During operation, the cooktop appliance operates the electric heating elements at a predetermined power output corresponding to a selected heating level.

Operating the electric heating elements at the predetermined power output corresponding to the selected heating level poses certain challenges. For example, the predetermined power input is only an indirect measurement of the actual cooking temperature. Some cooktop appliances employ a temperature sensor to directly measure the temperature of a cooking utensil and/or articles contained within the cooking utensil. The measured temperature may then be used to adjust the power output above or below the predetermined level in order to achieve a cooking temperature closer to the selected heating level.

However, if the temperature sensor fails or becomes inoperative, the power output will no longer be adjusted and may remain at a level that is unsuitable for extended use, which can degrade the cooking performance of the cooktop appliance.

Accordingly, a cooktop appliance with features for avoiding such degraded cooking performance would be useful. In particular, a cooktop appliance with features for managing a power output of heating elements of the cooktop appliance in the event of a loss of signal from a temperature sensor would be particularly beneficial.

BRIEF DESCRIPTION OF THE INVENTION

Aspects and advantages of the invention will be set forth in part in the following description, or may be apparent from the description, or may be learned through practice of the invention.

In an exemplary aspect of the present disclosure, a cooktop appliance is provided. The cooktop appliance includes an electric heating element positioned on a cooktop surface of the cooktop appliance and a controller operably connected to the electric heating element. The controller is configured for generating a temperature setting and initiating a preheat cycle. The preheat cycle includes operating the electric heating element at a predetermined power level corresponding to the temperature setting and monitoring a temperature with a temperature sensor until the monitored temperature reaches the temperature setting. The controller is also configured for initiating a duty cycle when the monitored temperature reaches the temperature setting. The duty cycles includes monitoring the temperature with the temperature sensor, calculating a difference between the monitored temperature and the temperature setting, operating the electric heating element over a first period of time at multiple distinct power levels based at least in part on the calculated difference between the monitored temperature and the temperature setting, and deactivating the electric heating element for a second period of time based at least in part on the calculated difference between the monitored temperature and the temperature setting. The controller is further configured for storing the first period of time in a memory of the controller, storing an average of the multiple distinct power levels in the memory of the controller, and storing the second period of time in the memory of the controller. The controller is also configured for detecting a disconnection of the temperature sensor, operating the heating element at the stored average power level for a duration of time equal to the stored first period of time, and deactivating the heating element for a duration of time equal to the stored second period of time.

In another exemplary aspect of the present disclosure a cooktop appliance is provided. The cooktop appliance includes an electric heating element positioned on a cooktop surface of the cooktop appliance and a controller operably connected to the electric heating element. The controller is configured for monitoring a temperature with a temperature sensor, adjusting a power level of the electric heating element based at least in part on the monitored temperature over a first period of time, and deactivating the electric heating element for a second period of time based at least in part on the monitored temperature. The controller is also configured for storing the first period of time in a memory of the controller, storing an average power level over the first period of time in the memory of the controller, and storing the second period of time in the memory of the controller. The controller is further configured for detecting a disconnection of the temperature sensor, operating the heating element at the stored average power level for a first duration of time equal to the stored first period of time, and deactivating the heating element for a second duration of time equal to the stored second period of time.

In yet another exemplary aspect, a cooktop appliance is provided. The cooktop appliance includes an electric heating element positioned on a cooktop surface of the cooktop appliance and a controller operably connected to the electric heating element. The controller is configured for generating a temperature setting. The controller is also configured for operating the electric heating element at a power level, monitoring a temperature with a temperature sensor, inputting the monitored temperature into a control loop, and adjusting the power level of the electric heating element based at least in part on an output of the control loop. The controller is also configured for storing temperature data in a memory of the controller. The stored temperature data includes a maximum value of the monitored temperature, a minimum value of the monitored temperature, and a time interval between the maximum value and the minimum value. The controller is also configured for detecting a disconnection of the temperature sensor, inputting the stored temperature data into the control loop, and adjusting the power level of the electric heating element based at least in part on an output generated by the control loop in response to the stored temperature data input.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
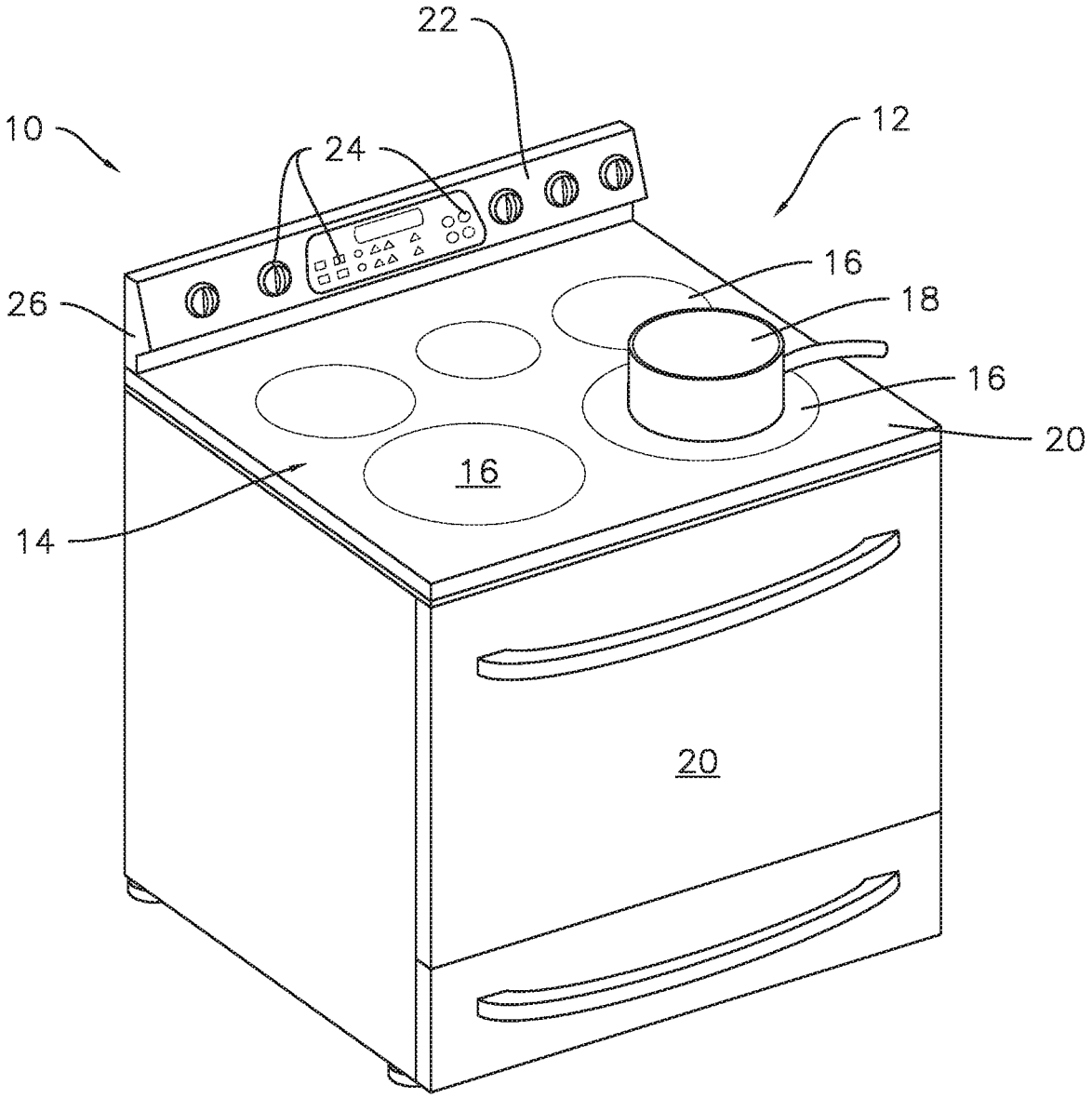
FIG. 1 provides a perspective view of a range having a cooktop appliance according to one or more exemplary embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a range appliance, or range 10, including a cooktop appliance 12. Range 10 is provided by way of example only and is not intended to limit the present subject matter to the arrangement shown in FIG. 1. Thus, the present subject matter may be used with other range 10 and/or cooktop appliance 12 configurations, e.g., double oven range appliances, standalone cooktop appliances, cooktop appliances without an oven, etc.

A cooking surface 14 of cooktop appliance 12 includes a plurality of heating elements 16. For the embodiment depicted, the cooktop appliance 12 includes five heating elements 16 spaced along cooking surface 14. The heating elements 16 are generally electric heating elements. In certain exemplary embodiments, cooktop appliance 12 may be an induction cooktop appliance with induction heating elements or coils mounted below cooking surface 14. However, in other embodiments, the cooktop appliance 12 may include any other suitable shape, configuration, and/or number of heating elements 16. Additionally, in other embodiments, the cooktop appliance 12 may include any other suitable type of heating element 16, such as a resistance heating element. Each of the heating elements 16 may be the same type of heating element 16, or cooktop appliance 12 may include a combination of different types of heating elements 16.

As shown in FIG. 1, a cooking utensil 18, such as a pot, pan, or the like, may be placed on a heating element 16 to heat the cooking utensil 18 and cook or heat food items placed in cooking utensil 18. Range appliance 10 also includes a door 20 that permits access to a cooking chamber (not shown) of range appliance 10, e.g., for cooking or baking of food items therein. A control panel 22 having controls 24 permits a user to make selections for cooking of food items. Although shown on a backsplash or back panel 26 of range appliance 10, control panel 22 may be positioned in any suitable location. Controls 24 may include buttons, knobs, and the like, as well as combinations thereof. As an example, a user may manipulate one or more controls 24 to select a temperature and/or a heat or power output for each heating element 16. The selected temperature or heat output of heating element 16 affects the heat transferred to cooking utensil 18 placed on heating element 16.

As will be discussed in greater detail below, the cooktop appliance 12 includes a control system 100 (FIG. 3) for controlling one or more of the plurality of heating elements 16. Specifically, the control system 100 may include a controller 52 (FIG. 3) operably connected to the control panel 22 and controls 24. The controller 52 may be operably connected to each of the plurality of heating elements 16 for controlling a power level of each of the plurality of heating elements 16 in response to one or more user inputs received through the control panel 22 and controls 24.

Figure 2:
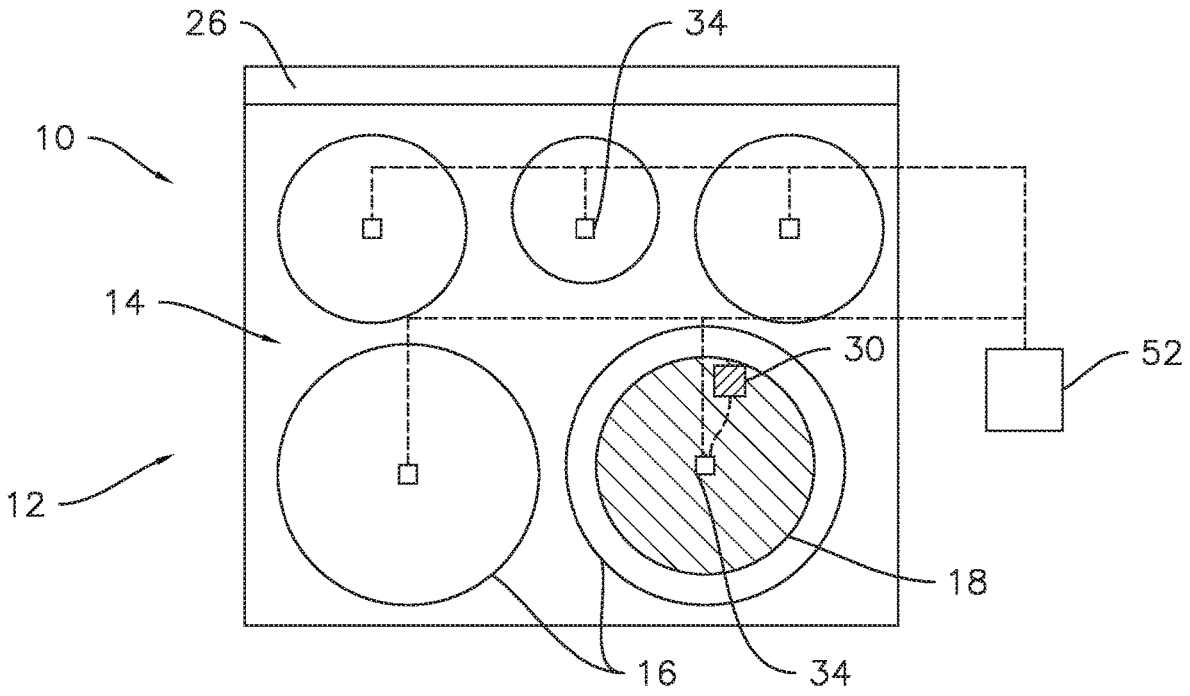
FIG. 2 provides a top, schematic view of the exemplary cooktop appliance of FIG. 1.

Referring now to FIG. 2, a top, schematic view of the cooktop appliance 12 of FIG. 1, or more specifically of the cooking surface 14 of the cooktop appliance 12 of FIG. 1, is provided. As stated, the cooking surface 14 of the cooktop appliance 12 for the embodiment depicted includes five heating elements 16 spaced along the cooking surface 14. A cooking utensil 18, also depicted schematically, is positioned on a first heating element 16 of the plurality of heating elements 16. For the embodiment depicted, a temperature sensor 30 is associated with the heating element 16.

In some example embodiments, the temperature sensor 30 may be positioned at any suitable location to sense a temperature associated with the cooking utensil 18 while the cooking utensil 18 is positioned on the heating element 16. For example, the temperature sensor 30 may sense a temperature of the cooking utensil 18 itself, e.g., at a bottom or a side portion thereof, or the temperature sensor 30 may sense a temperature of one or more food items 32 (see FIG. 3) positioned within the cooking utensil 18. For example, the food temperature sensor 30 may be a probe type temperature sensor configured to be inserted into one or more food items 32. Alternatively, however, the food temperature sensor 30 may be configured to determine a temperature of one or more food items positioned within the cooking utensil 18 in any other suitable manner.

In certain exemplary embodiments, the temperature sensor 30 may utilize any suitable technology for sensing/determining a temperature of the cooking utensil 18 and/or food 32 positioned in the cooking utensil 18. For example, the temperature sensor 30 may utilize one or more thermocouples, thermistors, optical temperature sensors, infrared temperature sensors, etc.

Referring still to FIG. 2, the cooktop appliance 12 additionally includes a plurality of receivers 34, each receiver 34 associated with an individual heating element 16. Each receiver 34 is configured to receive a signal from the temperature sensor 30 indicative of a temperature associated with the cooking utensil 18, e.g., a temperature of the one or more food items 32 positioned within the cooking utensil 18 positioned on a respective heating element 16. In at least some exemplary embodiments, the temperature sensor 30 may include transmitting capabilities, or alternatively may be hard-wired to the receiver 34 through a wired communications bus.

Figure 3:
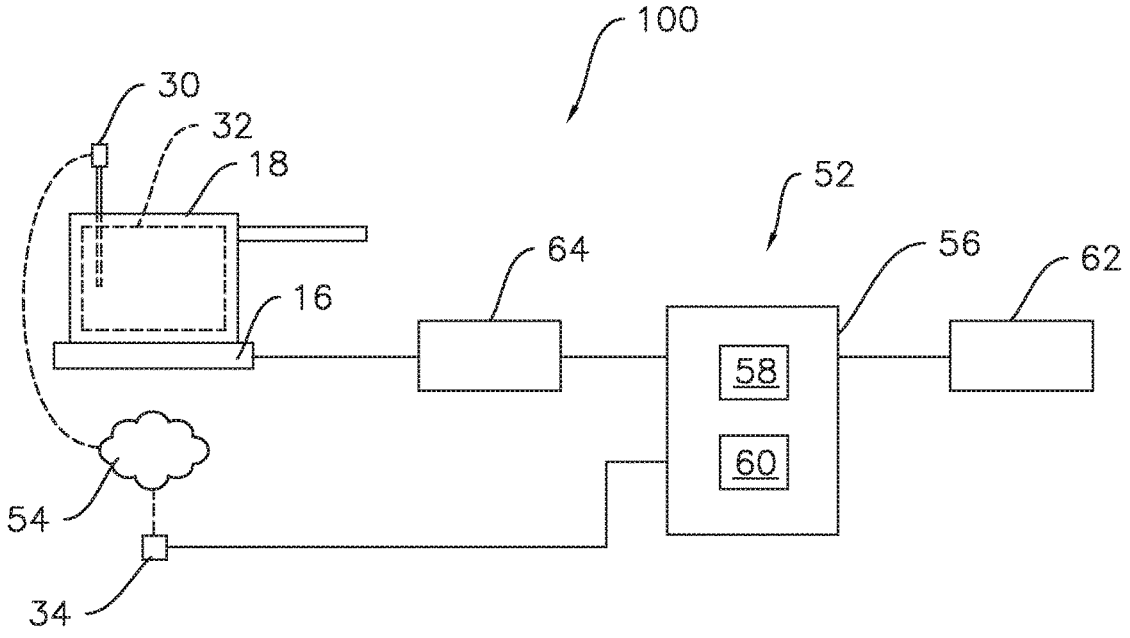
FIG. 3 provides a schematic diagram of a control system as may be used with the exemplary cooktop appliance of FIG. 2.

Referring now also to FIG. 3, a schematic view of a system for operating a cooktop appliance 12 in accordance with an exemplary embodiment of the present disclosure is provided. Specifically, FIG. 3 provides a schematic view of a heating element 16 of the exemplary cooktop appliance 12 of FIGS. 1 and 2 and an exemplary control system 100.

As stated, the cooktop appliance 12 includes a receiver 34 associated with each heating element 16. For the embodiment depicted, each receiver 34 is positioned directly below a center portion of a respective heating element 16. Moreover, for the embodiment depicted, each receiver 34 is configured as a wireless receiver 34 configured to receive one or more wireless signals. Specifically, for the exemplary control system 100 depicted, the temperature sensor 30 is configured as a wireless sensor in wireless communication with the wireless receiver 34 via a wireless communications network 54. In certain exemplary embodiments, the wireless communications network 54 may be a wireless sensor network (such as a Bluetooth communication network), a wireless local area network (WLAN), a point-to point communication networks (such as radio frequency identification networks, near field communications networks, etc.), or a combination of two or more of the above communications networks.

Referring still to FIG. 3, each receiver 34 associated with a respective heating element 16 is operably connected to a controller 52 of the control system 100. The receivers 34 may be operably connected via a wired communication bus (as shown), or alternatively through a wireless communication network similar to the exemplary wireless communication network 54 discussed above. The controller 52 may generally include a computing device 56 having one or more processor(s) 58 and associated memory device(s) 60. The computing device 56 may be configured to perform a variety of computer-implemented functions to control the exemplary cooktop appliance 12. The computing device 56 can include a general purpose computer or a special purpose computer, or any other suitable computing device. It should be appreciated, that as used herein, the processor 58 may refer to a controller, a microcontroller, a microcomputer, a programmable logic controller (PLC), an application specific integrated circuit, and other programmable circuits. Additionally, the memory device(s) 60 may generally comprise memory element(s) including, but not limited to, computer readable medium (e.g., random access memory (RAM)), computer readable non-volatile medium (e.g., a flash memory), a compact disc-read only memory (CD-ROM), a magneto-optical disk (MOD), a digital versatile disc (DVD), and/or other suitable memory elements. The memory 60 can store information accessible by processor(s) 58, including instructions that can be executed by processor(s) 58. For example, the instructions can be software or any set of instructions that when executed by the processor(s) 58, cause the processor(s) 58 to perform operations. For the embodiment depicted, the instructions may include a software package configured to operate the system to, e.g., execute the exemplary methods described below.

Referring still to FIG. 3, the control system 100 additionally includes a user interface 62 operably connected to the controller 52. For the embodiment depicted, the user interface 62 is configured in wired communication with the controller 52. However, in other exemplary embodiments, the user interface 62 may additionally, or alternatively, be wirelessly connected to the controller 52 via one or more suitable wireless communication networks (such as the exemplary wireless communication network 54 described above). In certain exemplary embodiments, user interface 62 may be configured as the control panel 22 and plurality of controls 24 on the cooktop appliance 12 (see FIG. 1). Additionally, or alternatively, the user interface 62 may be configured as an external computing device, such as a smart phone, tablet, or other device capable of connecting to the controller 52 of the exemplary control system 100. Signals generated in controller 52 operate appliance 12 in response to user input via the user interface 62.

Further, the controller 52 is operably connected to each of the plurality of heating elements 16 for controlling a power level of each of the plurality of heating elements 16 in response to one or more user inputs through the user interface 62 (e.g., control panel 22 and controls 24). Specifically, for the embodiment depicted, the controller 52 is operably connected to a plurality of power level control devices 64, each power level control device 64 associated with a respective one of the heating elements 16. For example, wherein one or more of the heating elements 16 are configured as electric resistance heaters, the controller 52 may be operably connected to respective relays, triodes for alternating current, or other devices for controlling an amount of power to such electrical resistance heaters. Alternatively, in embodiments wherein one or more of the heating elements 16 are configured as induction heating elements, the controller 52 may be operably connected to respective current control devices.

Figure 4:
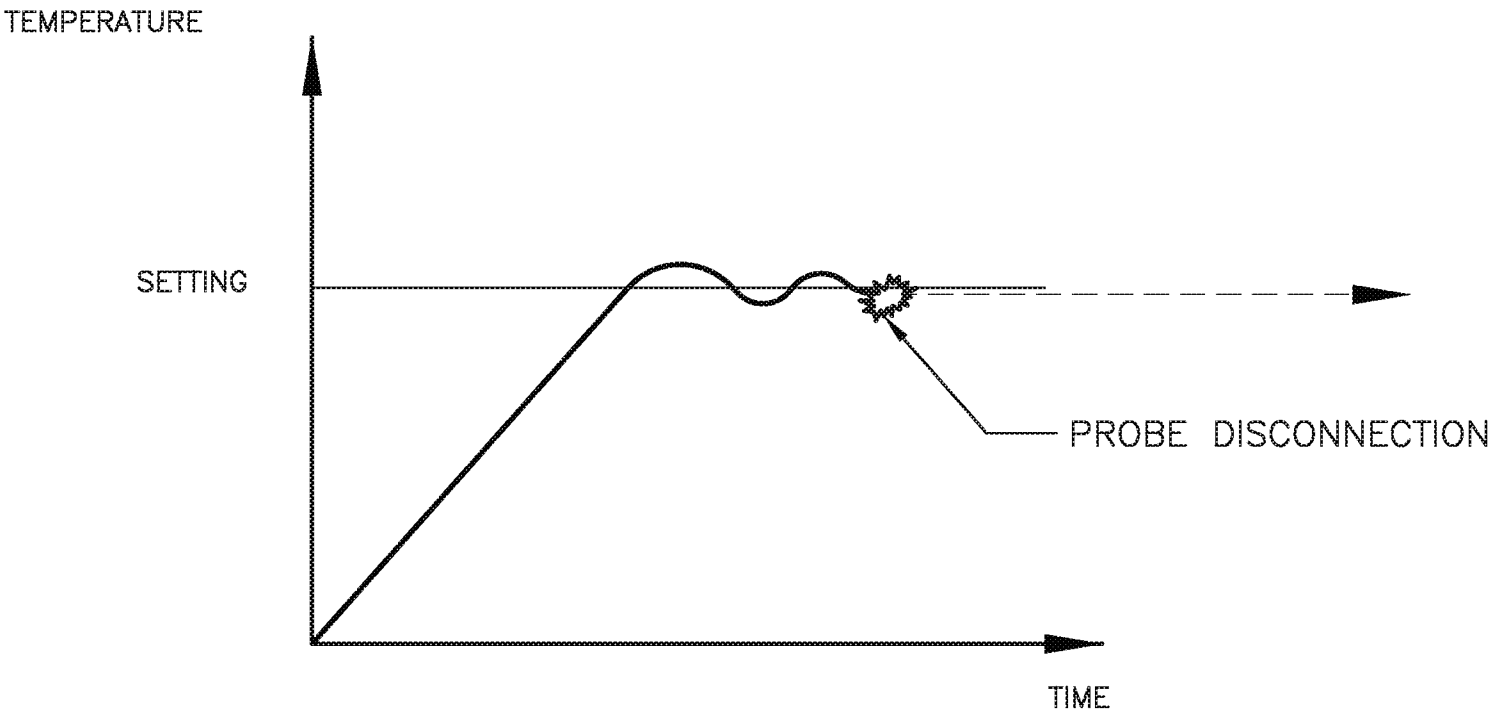
FIG. 4 provides a graph of a monitored temperature over time as compared to a temperature setting of a cooktop appliance in accordance with one or more exemplary embodiments of the present disclosure.

Referring now to FIG. 4, a graph of temperature over time in accordance with an exemplary aspect of the present disclosure is provided. In particular, the temperature depicted in the graph of FIG. 4 may be a monitored temperature, for example a temperature associated with a cooking utensil, such as cooking utensil 18 positioned on one of the electric heating elements 16. Temperatures associated with the cooking utensil 18 which may be monitored in various embodiments includes temperatures of the cooking utensil 18 itself, e.g., at a bottom of the cooking utensil 18 and/or a side of the cooking utensil 18, or a temperature of the contents of the cooking utensil 18, e.g., food items 32 as shown in FIG. 3, may be monitored as well as or instead of the temperature(s) of the cooking utensil 18 itself.

As may be seen in FIG. 4, the temperature starts out well below the temperature setting. For example, the initial temperature at time zero may be approximately room temperature, e.g., between about sixty-five degrees Fahrenheit (65° F.) and about seventy-five degrees Fahrenheit (75° F.). As used herein, terms of approximation, such as "generally," or "about" include values within ten percent greater or less than the stated value. The temperate may be monitored with the temperature sensor 30, e.g., the temperature values represented in FIG. 4 may be continuously measured by the temperature sensor 30 over time during the operation of the cooktop appliance 12. Thus, it should be understood that "monitored," "monitoring," or other cognates thereof as used herein include continuous or repeated measuring or sampling of data, e.g., temperature, over a period of time.

The time period from time zero until the initial intercept, e.g., where the monitored temperature first reaches the temperature setting, may comprise a preheat cycle. For example, the cooktop appliance 12 and/or a controller 52 thereof may be configured to generate a temperature setting, e.g., the temperature setting may be generated by the controller 52 in response to a user input received via the user interface 62 (FIG. 3). The controller 52 may be further configured for initiating the preheat cycle, which may include operating a heating element 16 at a predetermined power level corresponding to the temperature setting and monitoring a temperature with temperature sensor 30 until the monitored temperature reaches the temperature setting.

The controller 52 may initiate a duty cycle of the cooktop appliance 12 when the monitored temperature reaches the temperature setting. In various embodiments, as generally shown in FIG. 4, the duty cycle may include adjusting a power level of the heating element 16 based at least in part on the monitored temperature. For example, the monitored temperature may be input into a control loop, which is generally a closed control loop, such as a proportional-integral-derivative (PID) control loop, and the controller 52 may be configured for adjusting the power level of the heating element 16 based on the output of the control loop. In response to the adjustments to the power level of the heating element 16, the temperature will generally oscillate about the temperature setting with a decreasing amplitude of the oscillation over time. However, because the control loop is a closed loop, the control loop may not operate optimally without temperature data input, e.g., from the temperature sensor 30. As noted above, the temperature sensor 30 may include transmitting capabilities, or alternatively may be hard-wired. In various instances, the temperature sensor 30 may become disabled or disconnected. For example, the temperature sensor 30 may be disconnected due to a failure of the temperature sensor 30. In particular embodiments, e.g., where the temperature sensor 30 is a wireless sensor, the temperature sensor 30 may use battery power, such that the temperature sensor 30 may become disconnected when the batteries run out. When the temperature sensor 30 is disconnected, the controller 52 may be configured to maintain the temperature at or about the temperature setting (as represented by the dashed line in FIG. 4) in the absence of temperature data from the temperature sensor 30. Various embodiments of such configuration of the controller 52 will be described hereinbelow with respect to FIGS. 5 through 7.

Figure 5:
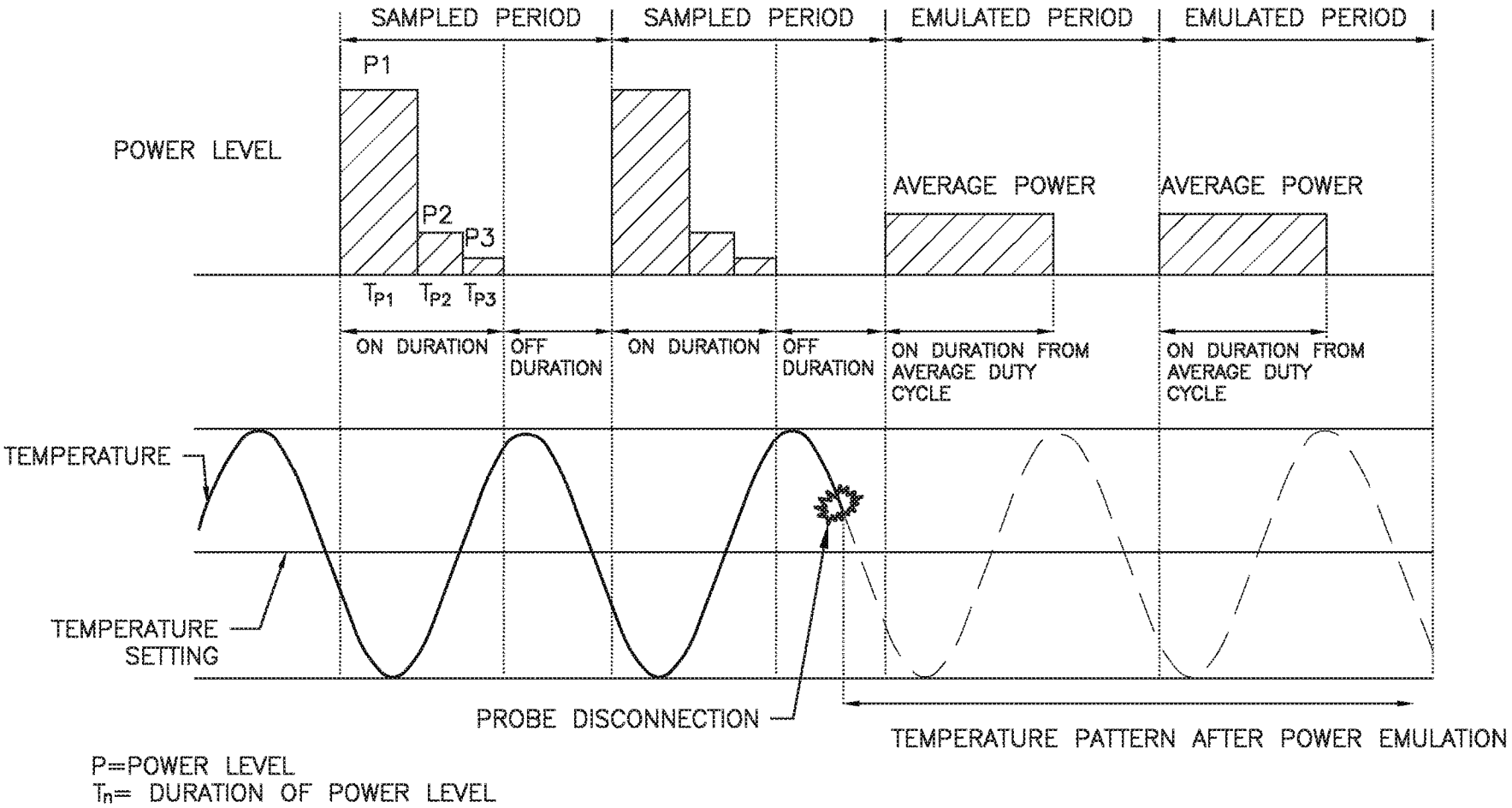
FIG. 5 provides a detailed view of a portion of the graph of FIG. 4 as well as associated power levels in accordance with one or more exemplary embodiments of the present disclosure.

As shown for example in FIG. 5, the duty cycle encompasses a time period including both an on duration and an off duration. Moreover, the temperature sensor 30 may continuously supply a temperature reading to the controller 52 during the duty cycle such that the duty cycle may include monitoring the temperature with the temperature sensor 30. As can be seen in FIG. 5, the temperature may vary above and below the temperature setting. The controller 52 may be configured for calculating a difference between the monitored temperature and the temperature setting. The duty cycle may include operating the electric heating element 16 over a first period of time, e.g., the on duration as noted in FIG. 5, at multiple distinct power levels. The duty cycle may include adjusting a power level of the heating element 16 over a first period of time, e.g., the on duration. During the duty cycle, the multiple distinct power levels and/or the adjustment of the power level may be based at least in part on the monitored temperature, e.g., may be based at least in part on the calculated difference between the monitored temperature and the temperature setting. For example, when the monitored temperature is significantly less than the temperature setting, the controller 52 may operate the heating element 16 at a first power level P1 for a first duration $T_{P1}$. Continuing the example, as the temperature approaches the temperature setting, the controller 52 may then operate the heating element 16 at a second power level P2, which is less than the first power level P1, for a second duration $T_{P2}$. In some example embodiments, the on duration may also include a third duration $T_{P3}$, wherein the controller 52 operates the heating element 16 at a third power level, P3, which is less than the second power level P2. Additionally, the on duration may include any suitable number of additional durations and corresponding power levels, e.g., a fourth duration $T_{P4}$, a fifth duration $T_{P5}$, etc. Note that the heating element 16 is active and operating during the on duration, e.g., each of the multiple distinct power levels is greater than zero, e.g., adjusting the power level of the heating element 16 over the on duration may include adjusting the power level within a range, wherein the lower limit of the range is greater than zero.

Still with reference to FIG. 5, the duty cycle may also include an off duration. One of ordinary skill will recognize that the heating element 16 is not operating during the off duration. The controller 52 may be configured for deactivating the heating element 16 for a second period of time based at least in part on the monitored temperature, e.g., based at least in part on the calculated difference between the monitored temperature and the temperature setting. For example, when the monitored temperature is greater than the temperature setting by more than a certain threshold amount, the controller 52 may deactivate the heating element 16 for the second period of time, e.g., an off duration, until the monitored temperature drops to a certain level, such as a certain level relative to the temperature setting. At that point, the controller 52 may initiate a subsequent duty cycle, e.g., as shown in FIG. 5, which may include the same or similar power levels and time durations as the previous duty cycle.

As indicated in FIG. 5, duty cycles wherein the temperature is monitored, e.g., using temperature sensor 30, comprise sampled periods, e.g., the temperature data provided to the controller 52 which may provide at least part of the basis for adjusting the power level of the heating element 16 is sampled data during those duty cycles. The controller 52 may be configured for storing data from one or more sampled periods in a memory of the controller 52, e.g., memory 60 as shown in FIG. 3 and described hereinabove. In some embodiments, the controller 52 may store only the data associated with the most recent complete duty cycle or sample period in the memory 60. The controller 52 may be configured for storing the first period of time, e.g., the on duration, associated with the one or more sampled periods. The controller 52 may be configured for storing an average of the multiple distinct power levels, e.g., P1, P2, and/or P3, in the memory 60. The controller 52 may also be configured for storing the second period of time, e.g., the off duration, in the memory 60.

In some embodiments, for example as illustrated in FIG. 5, the controller 52 may be configured to maintain the temperature at or about the temperature setting based on the stored data described above. For example, the controller 52 may be configured for detecting a disconnection of the temperature sensor 30, e.g., when the signal from the temperature sensor 30 is lost or interrupted during the duty cycle. Upon detecting the disconnection of the temperature sensor 30, the controller 52 may be configured for operating the heating element 16 according to an emulated duty cycle, e.g. the controller 52 may be configured for operating the heating element 16 at the stored average power level for a duration of time equal to the stored first period of time and deactivating the heating element for a duration of time equal to the stored second period of time. As shown in FIG. 5, the temperature during the emulated period will generally approximate the temperature curve during the sampled period(s). The temperature during the emulated period is illustrated by a dashed line in FIG. 5 to indicate that the temperature may not be directly measured during the emulated period, e.g., when the temperature sensor 30 is disconnected. Upon completion of the emulated duty cycle, the controller 52 may operate the heating element 16 for another emulated duty cycle, e.g., as illustrated in FIG. 5. For example, if the connection to the temperature sensor 30 is not re-established, the controller 52 may iterate the emulated duty cycle multiple times. However, it should be understood that the controller 52 will not operate the heating element 16 indefinitely; one of ordinary skill will recognize that the cooking operation will generally include some end point. For example, the end point may be based on a cooking time generated by the controller 52 in response to one or more user inputs through the user interface 62, where the end of the cooking time comprises an end point to the cooking operation. Further, in some instances, the signal from the temperature sensor 30 may be restored, e.g., when a user replaces a dead battery or plugs in a rechargeable temperature sensor 30. Thus, the controller 52 may be further configured for detecting a reconnection of the temperature sensor 30, resuming monitoring the temperature, and performing one or more duty cycles, as described above.

Figure 6:
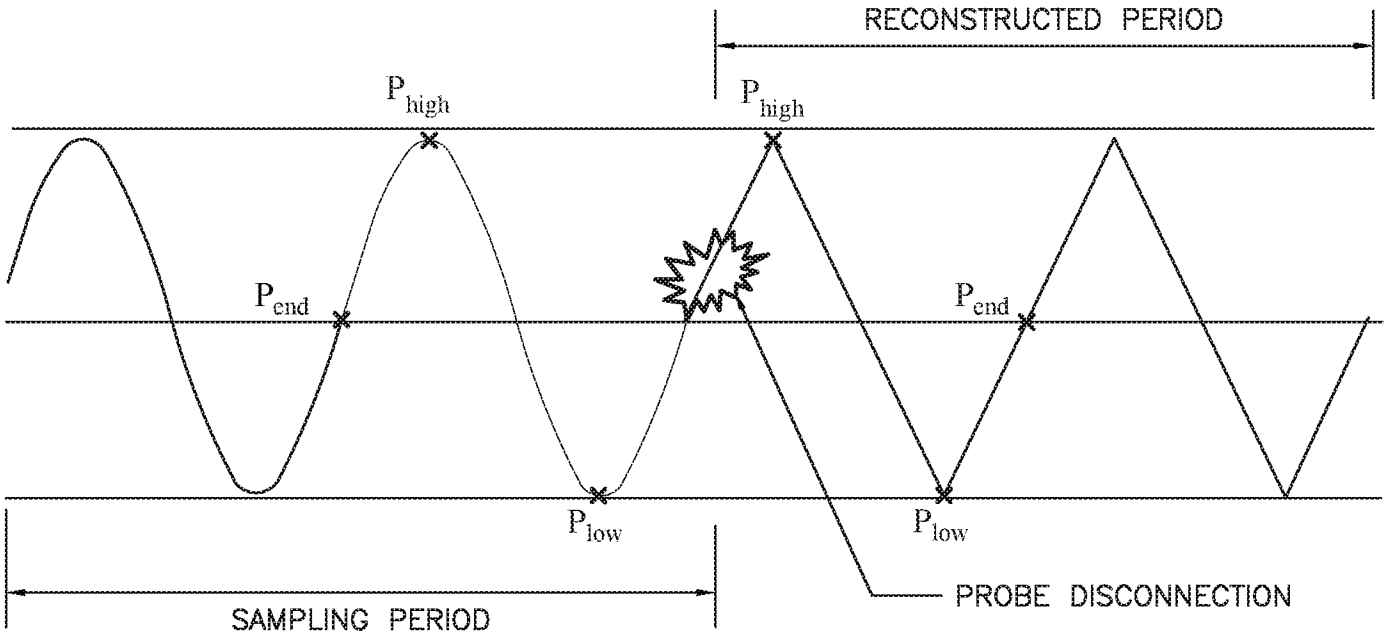
FIG. 6 provides a detailed view of a portion of the graph of FIG. 4 in accordance with additional exemplary embodiments of the present disclosure.

As shown in FIG. 6, the operation of the cooktop appliance may comprise a sampling period, e.g., a period of operation wherein the temperature associated with the cooking utensil 18, e.g., the temperature of one or more food items 32 (FIG. 3) positioned within the cooking utensil 18, is continuously sampled by the temperature sensor 30. In some example embodiments, the controller 52 may be configured for operating the heating element 16 at a power level, which may be a predetermined power level based on the temperature setting. The controller 52 may also be configured for monitoring a temperature with temperature sensor 30 and inputting the monitored temperature into a control loop, e.g., a PID control loop. The controller 52 may further be configured for adjusting the power level of the heating element 16 based at least in part on an output of the control loop.

At least some of the monitored data may be stored in the memory 60 of the controller 52. For example, the temperature may oscillate between a maximum value or a high, $P_{high}$, and a minimum value or a low, $P_{low}$, with an intercept value, $P_{end}$, where the monitored temperature is equal to the temperature setting, between $P_{high}$ and $P_{low}$. Accordingly, in some embodiments, the controller 52 may be configured for storing temperature data in the memory 60 of the controller 52. The stored temperature data may include temperature measurements as well as related data. In some exemplary embodiments, the stored temperature data may include a maximum value $P_{high}$ of the monitored temperature, a minimum value $P_{low}$ of the monitored temperature, and a time interval between the maximum value and the minimum value. In additional exemplary embodiments, the stored temperature data may also include an intercept value $P_{end}$ of the monitored temperature and a time interval between the intercept value $P_{end}$ and one of the maximum value $P_{high}$ and the minimum value $P_{low}$.

As illustrated in FIG. 6, the temperature data, e.g., the maximum value $P_{high}$, the minimum value $P_{low}$, and the time interval therebetween, may define a slope. During the sampling period, e.g., when the controller 52 receives continuously measured temperature data and may input said data into the control loop, the temperature over time, as shown in FIG. 6, defines a variable slope, e.g., a curve, between the maximum value $P_{high}$ and the minimum value $P_{low}$, and/or between the intercept value $P_{end}$ and one or both of the maximum value $P_{high}$ and the minimum value $P_{low}$.

The controller 52 may be configured for detecting a disconnection of the temperature sensor 30, e.g., when the signal from the temperature sensor 30 is lost or interrupted. Upon detecting the disconnection of the temperature sensor 30, the controller 52 may be configured for inputting the stored temperature data into the control loop. For example, as illustrated in FIG. 6, the stored temperature data may include three temperature values, $P_{high}$, $P_{low}$, and $P_{end}$, and time intervals therebetween. In other example embodiments, more than three temperature values may be stored, e.g., a temperature value may be stored every second for a five-minute interval. The controller 52 may also be configured for adjusting the power level of the heating element 16 based at least in part on an output generated by the control loop in response to the stored temperature data input. Thus, the controller 52 may reproduce or approximate the temperature curve after the sensor disconnection albeit with a more linear slope. As indicated in FIG. 6, the temperature curve resulting from inputting the stored data may be considered a reconstructed curve, and the period during which the controller is adjusting the power level of the heating element 16 based at least in part on the output generated by the control loop in response to the stored temperature data input may be considered a reconstructed period. In other embodiments, e.g., where more than three temperature values may be stored, the controller 52 may provide a closer approximation of the sampling period temperature curve in the reconstructed period. Thus, one of skill in the art would recognize that at least two temperature values may be stored in order to provide input to the control loop when the temperature sensor 30 is disconnected, and that many more than two values may be stored. It may be advantageous to store fewer temperature values, e.g., two or three values, to conserve computing resources of the control system 100. It may be advantageous to store more temperature values to provide a closer approximation of the monitored temperature values to the control loop.

Figure 7:
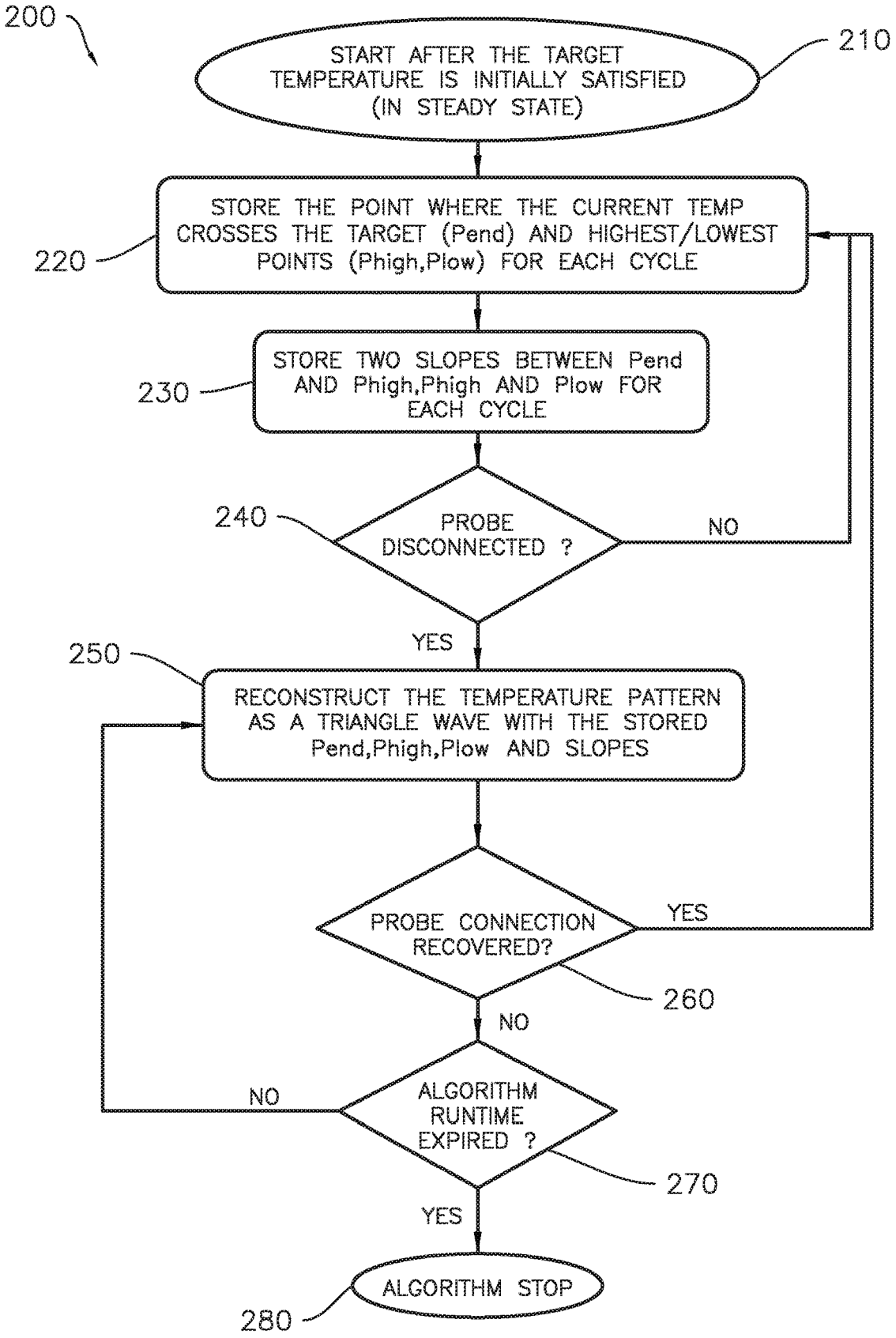
FIG. 7 provides a flow chart of an exemplary method of operating a cooktop appliance.

FIG. 7 illustrates a flow chart of an example method 200 of operating a cooktop appliance. It should be understood that the control system 100 and/or controller 52 described hereinabove may be configured for performing some or all of the steps of the exemplary method 200. As shown in FIG. 7, the method 200 may include a start point 210, wherein the temperature setting or target temperature has been initially satisfied, e.g., at the end of a preheat cycle, as described above. The method 200 may also include a storing step 220, wherein temperature data is stored in a memory 60 of the controller 52, e.g., the maximum value $P_{high}$, the minimum value $P_{low}$, and the intercept value $P_{end}$. At step 240, the method 200 may include determining whether a probe, which may be an embodiment of temperature sensor 30, is disconnected. As shown, when the probe is not disconnected, the method 200 may continue or repeat steps 220 and 230. Further, when the probe is disconnected, the method 200 may include a step 250 of reconstructing the temperature pattern as a triangle wave, e.g., a curve with a straight-line slope between the stored temperature values, as shown in FIG. 6 to the right of the probe disconnection. At step 260, the method 200 may include determining whether the connection to temperature sensor 30, e.g., probe has been recovered. When the connection is recovered, the method 200 may return to step 220. When the connection is not recovered, the method 200 may include determining at 270 whether an algorithm runtime, e.g., a cooking time generated by the controller 52 in response to one or more user inputs through the user interface 62, has expired. When the runtime has not expired, the method 200 may repeat steps 250 and 260. When the runtime has expired, the method 200 may end, e.g., at algorithm stop 280.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance, comprising:

an electric heating element positioned on a cooktop surface of the cooktop appliance; and a controller operably connected to the electric heating element, the controller configured for:

generating a temperature setting;

initiating a preheat cycle, the preheat cycle comprising operating the electric heating element at a predetermined power level corresponding to the temperature setting and monitoring a temperature with a temperature sensor until the monitored temperature reaches the temperature setting;

initiating a duty cycle when the monitored temperature reaches the temperature setting, the duty cycle comprising monitoring the temperature with the temperature sensor, calculating a difference between the monitored temperature and the temperature setting, operating the electric heating element over a first period of time at multiple distinct power levels based at least in part on the calculated difference between the monitored temperature and the temperature setting, and deactivating the electric heating element for a second period of time based at least in part on the calculated difference between the monitored temperature and the temperature setting;

storing the first period of time in a memory of the controller;

storing an average of the multiple distinct power levels in the memory of the controller;

storing the second period of time in the memory of the controller;

detecting a disconnection of the temperature sensor; after detecting the disconnection of the temperature sensor operating the heating element at the stored average power level for a duration of time equal to the stored first period of time; and deactivating the heating element for a duration of time equal to the stored second period of time.

2. The cooktop appliance of claim 1, wherein the monitored temperature is a temperature associated with a cooking utensil positioned on the electric heating element.

3. The cooktop appliance of claim 1, further comprising a wireless receiver operably connected to the controller, wherein the controller is configured for receiving a signal from the temperature sensor using the wireless receiver, and wherein the controller is configured for detecting the disconnection of the temperature sensor when the signal from the temperature sensor is interrupted during the duty cycle.

4. The cooktop appliance of claim 1, further comprising a user interface operatively connected to the controller, wherein the controller is configured for generating the temperature setting in response to a user input received via the user interface.

5. The cooktop appliance of claim 1, wherein the electric heating element is a resistance heating element.

6. The cooktop appliance of claim 1, wherein the electric heating element is an induction heating element.

7. A cooktop appliance, comprising:

an electric heating element positioned on a cooktop surface of the cooktop appliance; and a controller operably connected to the electric heating element, the controller configured for:

monitoring a temperature with a temperature sensor;

adjusting a power level of the electric heating element based at least in part on the monitored temperature over a first period of time;

deactivating the electric heating element for a second period of time based at least in part on the monitored temperature;

storing the first period of time in a memory of the controller;

storing an average power level over the first period of time in the memory of the controller;

storing the second period of time in the memory of the controller;

detecting a disconnection of the temperature sensor; after detecting the disconnection of the temperature sensor operating the heating element at the stored average power level for a first duration of time equal to the stored first period of time; and deactivating the heating element for a second duration of time equal to the stored second period of time.

8. The cooktop appliance of claim 7, wherein the monitored temperature is a temperature associated with a cooking utensil positioned on the electric heating element.

9. The cooktop appliance of claim 7, further comprising a wireless receiver operably connected to the controller, wherein the controller is configured for receiving a signal from the temperature sensor using the wireless receiver, and wherein the controller is configured for detecting the disconnection of the temperature sensor when the signal from the temperature sensor is lost.

10. The cooktop appliance of claim 7, wherein the controller is further configured for generating a temperature setting, wherein the step of adjusting the power level is based at least in part on the temperature setting and the step of deactivating the electric heating element for the second period of time is based at least in part on the temperature setting.

11. The cooktop appliance of claim 10, further comprising a user interface operatively connected to the controller, wherein the controller is configured for generating the temperature setting in response to a user input received via the user interface.

12. The cooktop appliance of claim 7, wherein the electric heating element is a resistance heating element.

13. The cooktop appliance of claim 7, wherein the electric heating element is an induction heating element.

14. A cooktop appliance, comprising:

an electric heating element positioned on a cooktop surface of the cooktop appliance; and a controller operably connected to the electric heating element, the controller configured for:

generating a temperature setting;

operating the electric heating element at a power level;

monitoring a temperature with a temperature sensor;

inputting the monitored temperature into a control loop;

adjusting the power level of the electric heating element based at least in part on an output of the control loop;

storing temperature data in a memory of the controller, the stored temperature data comprising a maximum value of the monitored temperature, a minimum value of the monitored temperature, and a time interval between the maximum value and the minimum value;

detecting a disconnection of the temperature sensor;

operating the heating element at the stored average power level for a duration of time equal to the stored first period of time, after detecting the disconnection of the temperature sensor;

inputting the stored temperature data into the control loop; and adjusting the power level of the electric heating element based at least in part on an output generated by the control loop in response to the stored temperature data input.

15. The cooktop appliance of claim 14, wherein the stored data further comprises an intercept value of the monitored temperature equal to the temperature setting and a time interval between the intercept value and one of the maximum value and the minimum value.

16. The cooktop appliance of claim 14, wherein the monitored temperature is a temperature associated with a cooking utensil positioned on the electric heating element.

17. The cooktop appliance of claim 14, further comprising a wireless receiver operably connected to the controller, wherein the controller is configured for receiving a signal from the temperature sensor using the wireless receiver, and wherein the controller is configured for detecting the disconnection of the temperature sensor when the signal from the temperature sensor is lost.

18. The cooktop appliance of claim 14, further comprising a user interface operatively connected to the controller, wherein the controller is configured for generating the temperature setting in response to a user input received via the user interface.

19. The cooktop appliance of claim 14, wherein the electric heating element is a resistance heating element.

20. The cooktop appliance of claim 14, wherein the electric heating element is an induction heating element.

* * * * *